US006941676B2

(12) United States Patent
Akimoto et al.

(10) Patent No.: US 6,941,676 B2
(45) Date of Patent: Sep. 13, 2005

(54) APPARATUS FOR FREEZE-DRYING FOODSTUFFS AND MEDICAMENTS

(75) Inventors: Hiromichi Akimoto, Tokyo (JP); Ryoji Sunama, Tokyo (JP)

(73) Assignee: Kyowa Vacuum Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/035,421

(22) Filed: Jan. 4, 2002

(65) Prior Publication Data

US 2002/0189127 A1 Dec. 19, 2002

(30) Foreign Application Priority Data

Jun. 14, 2001 (JP) ..... 2001-180712

(51) Int. Cl.[7] ..... F26B 17/12

(52) U.S. Cl. ..... 34/176; 34/285; 34/296; 34/576; 34/179; 34/180; 34/92

(58) Field of Search ..... 34/284–288, 290, 34/291, 294–300, 376, 380, 381, 384–386, 576, 578, 586, 80, 176, 179, 180–183, 92; 62/66–72

(56) References Cited

U.S. PATENT DOCUMENTS 3,132,929 A * 5/1964 Thuse ..... 34/77
3,198,492 A * 8/1965 Schneider ..... 366/107
3,396,475 A * 8/1968 Scheibel ..... 34/288
3,759,047 A * 9/1973 King et al. ..... 62/66
4,016,657 A * 4/1977 Passey ..... 34/92
4,175,334 A * 11/1979 Gibert ..... 34/286
4,449,305 A * 5/1984 Baron et al. ..... 34/92
4,561,191 A * 12/1985 Parkinson ..... 34/290
4,590,684 A * 5/1986 Arsem ..... 34/284
4,802,286 A * 2/1989 Kobayashi et al. ..... 34/289
5,035,065 A * 7/1991 Parkinson ..... 34/92
5,090,132 A * 2/1992 Kobayashi et al. ..... 34/302
5,208,998 A * 5/1993 Oyler, Jr. ..... 34/288
5,230,162 A * 7/1993 Oyler, Jr. ..... 34/292
6,470,592 B2 * 10/2002 Akimoto et al. ..... 34/92

* cited by examiner

*Primary Examiner*—Henry Bennett
*Assistant Examiner*—Andrea M. Ragonese
(74) *Attorney, Agent, or Firm*—Browdy and Neimark, P.L.L.C.

(57) ABSTRACT

Disclosed is a freeze-drying apparatus for foodstuffs, medicaments, etc., wherein liquid material is directly and distributively poured into upright cylindrical tubes, then, in its isolated state from external atmosphere for perfect sterilization, the liquid material is frozen with uniform thickness onto inner wall surface of the tubes, with further possibility of uniform heating of the freeze-dried layer. The main body of this apparatus is constructed with upright cylindrical tubes for freezing liquid material onto inner surface of tubes and jackets to surround the outer periphery of each of the tubes in a substantially concentric cylindrical shape, within which to circulate heat medium; then, a duct communicating to the vacuum exhaust system is connected to the upper end side of these tubes, while, a recovery chamber provided with valve is connected to the lower end side of tubes; and an inlet port is defined for feeding liquid material into inner cavity of tubes.

7 Claims, 9 Drawing Sheets

APPARATUS FOR FREEZE-DRYING FOODSTUFFS AND MEDICAMENTS

BACKGROUND OF THE INVENTION a) Field of the Invention

This invention relates to an improvement in a freeze-drying apparatus for foodstuffs, medicaments, and so forth, by which materials to be desiccated such as foodstuffs, medicaments, and so forth are adjusted in a liquid form, and then it is subjected to freezing, followed by its sublimation to remove the water (moisture) content in the material under the vacuum condition in a desiccating chamber of the freeze-drying apparatus.

b) Description of Prior Arts

Conventional freeze-drying apparatus, in which the materials to be freeze-dried such as foodstuffs, medicaments, etc. are adjusted into a liquid form and kept frozen, after which it is desiccated by sublimation of the moisture content in the material by supplying the sublimation heat to the materials for desiccation, under the vacuum condition, has usually been done in such a manner that the materials to be dried are adjusted into a liquid form, then the liquid materials are filled in a desiccating vessel such as trays, etc., each desiccating vessel being placed in a desiccating chamber of the freeze-drying apparatus provided with storing shelves, wherein these desiccating vessels are subjected to freezing to sublimate the water content in the liquid material by supplying the sublimation heat, within the drying chamber to capture the water vapor from the frozen liquid material by means of a cold-trap in the vacuum exhaustion system which is communicatively connected to the desiccating chamber.

As another expedient, there is one which has been developed by the applicant of the present invention. This expedient, as shown in FIG. 1 of the accompanying drawing, is of such a construction that the desiccating chamber of the freeze-drying apparatus is formed of a multitude of upright cylindrical tubes 1, 1, . . . to cause the liquid material (material prepared in liquid form for desiccation) to freeze on the inner wall surface thereof, which are arranged side by side in bundle at a predetermined space interval; then, a jacket 2 shaped in bucket- or vessel-form for circulating heat medium in and through these upright tubes is mounted around these bundled tubes; thereafter, an inlet tube 20 and an outlet tube 21 of this bucket- or vessel-shaped jacket 2 are connected to the tube-passageway of a heat-exchanger (not shown in the drawing) for circulating the heat medium to thereby cause the heat medium to circulate within the jacket 2, while, at the upper end side of each of the tubes 1, 1, . . . , there are communicatively connected a chamber or a duct 3 which communicates with a vacuum exhaust system equipped with a vacuum pump or a cold-trap (CT), and, at the lower end side of each of the tubes 1, 1, there is provided an opening-and-closing valve V to hermetically close the tubes, below the valve V of which a recovering chamber 4 is provided by connecting the same to the lower surface side of the jacket 2.

Supply of the liquid material to each of the tubes 1, 1, . . . is done by the following ways: that is to say, i) an inlet port 50 with a tube passageway 5 to feed the liquid material being connected to the downstream side of the tube passageway 5, through the inlet port of which the liquid material is pushed up into each of the tubes 1, 1, . . . ; or ii) as shown in FIG. 2, the downstream side of the abovementioned tube passageway 5 is introduced into the duct 3 which is communicated with the upper end side of each tube 1, while a distributive ejection head 51 is connected to the inlet port 50 at the terminal part of its downstream side, to which the distributive ejection nozzle 52 corresponding to each tube 1 is provided so as to distributively introduce the liquid material into the inner cavity of each of the tubes 1, 1, . . . through the distributive ejection nozzles 52, 52, . . . ; in this case, when the surface of the liquid material reaches the upper end side of each of the tubes 1, 1, . . . , supply of the liquid material is stopped, and the material is subjected to freezing on the inner wall surface of each tube 1 which is kept cooled by the heat medium within the jacket 2, whereby, as soon as the frozen layer attains its predetermined thickness, unfrozen liquid material is taken out of an outlet tube 6 disposed at a location of the lower end side of the tubes 1, 1 . . . , and of the upper surface side of the valve V, thereby freezing the liquid material on the inner wall surface of each tube 1 in a columnar shape of a predetermined thickness. Such column-shaped material as frozen is maintained in the vacuum condition by means of a vacuum exhaust system which is communicated with a chamber or a duct 3 to sublimate water (or moisture) content in the liquid material in its frozen state, by supplying heat of sublimation, thereby freeze-drying the liquid material. As soon as the material becomes completely dried, the valve V is opened to cause the material as dried in its cylindrical form to drop into the recovery chamber 4 as the dried bulk of the liquid material.

When the abovementioned starting material such as foodstuffs, medicaments, etc., which have been adjusted into the liquid form, is subjected to freeze-drying by means of the freeze-drying apparatus of a construction, in which the desiccating chamber is formed of a multitude of upright cylindrical tubes which are vertically erected within the jacket in a mutually juxtaposed relationship, through which the liquid material as adjusted is distributively ejected for freeze-drying, still possesses various difficult problems to be solved. That is to say, when the liquid material is frozen onto the inner wall surface of each of the cylindrical tubes in multiple numbers, which are disposed within the chamber in the mutually juxtaposed relationship, it becomes necessary that the liquid material should be frozen in a hollow cylindrical shape in its axial portion, so as to be able to attain uniform desiccation of the liquid material by the vacuum sublimation within each of the tubes in a range extending from its upper end side over to its lower end side, a difficult problem residing in this point.

Moreover, even though this liquid material should be able to freeze into a layer of a uniform thickness in the span of from the top to the bottom part of the inner wall surface of a single tube, if the frozen layer is not uniformly produced in each of the multitude of the mutually juxtaposed tubes, there will occur inconvenient problems such that the drying time for the liquid material becomes variant from one tube to another, when the moisture content in the material is sublimated under the vacuum condition for its freeze-drying; or the irregular drying of the liquid material may also take place, unless flux of the heat medium is uniformly supplied to each part of every tube during desiccation of the liquid material.

For attaining such uniform layer thickness, it is necessary that uniform heat-exchange should be secured between the heat medium within the jacket and each of the tubes in multiple numbers which are dippingly placed in the vessel-shaped jacket with a mutually juxtaposed relationship at a predetermined space interval therebetween. However, since the heat medium within the jacket is constantly circulating, flow of the heat medium and the juxtaposition of each of the tubes should be established to equalize the cooling and the heating of each tube, so that flow of the heat medium may be in uniform contact with each of the multitude of mutually juxtaposed tubes, which however belongs to a very difficult problem.

SUMMARY OF THE INVENTION

The present invention has been made with a view to solving the problem which is brought about when the freeze-drying apparatus is installed in the desiccating chamber, in the state of the liquid material such as foodstuffs, medicaments, etc. being isolated from external atmosphere to guarantee its perfectly sterilized condition, in such a manner that the liquid material may be directly distributed into each of the tubes by use of the freeze-drying apparatus of a configuration, in which the desiccating chamber is made up of a multitude of upright cylindrical tubes. That is to say, the present invention aims at providing an improved apparatus for freeze-drying of a type, in which the liquid material fed into the tubes is subjected to freezing to a uniform thickness with respect to the inner wall surface of the tubes, while making it possible to carry out simple and accurate controlled cooling of the tubes with the heat medium to be circulated in the jacket, and in which it is also subjected to uniform heat-desiccation.

It is also an object of the present invention to provide a novel expedient which is able to carry out uniform heating and drying.

With a view to attaining the abovementioned objects, the freeze-drying apparatus according to the present invention has been made on the basis of the research and finding conducted by various studies on the freeze-drying apparatus of a configuration, in which the desiccating chamber is constructed with a multitude of upright cylindrical tubes.

In more detail, the present invention could be thought out and completed from the following notions. That is to say, difficulty in the temperature control of the liquid material (material prepared in liquid form for desiccation), when the upright cylindrical tubes are subjected to cooling from their outer peripheries with use of the heat medium, for freezing the liquid material onto the inner wall surface of the upright cylindrical tubes in the cylindrical shape of a predetermined thickness, is due to the fact that the jacket for circulating the heat medium to cool the tubes is formed in the shape of a vessel having a large capacity, in the inner cavity of which a multitude of tubes are well arranged and dippingly placed, so as to cool the multitude of tubes at once. Contrary to this, if a construction is made such that the jacket is formed for each tube to surround the outer periphery of such individual tube concentrically so as to cause the heat medium, which is circulating within the jacket, to carry out cooling and heating of the individual tube, there is no necessity for disposing and arranging the tubes within the jacket so as to bring the individual tube into uniform contact with the flow of the heat medium circulating within the jacket. Also, control of the cooling temperature with use of the heat medium, when the liquid material is to be frozen on the inner wall surface of the tubes, can also be done for each tube, whereby the temperature control becomes able to be done easily.

From the foregoing, it is also an object of the present invention to provide means for constructing a freeze-drying apparatus for foodstuffs, medicaments, etc., by defining a desiccating chamber for sublimating moisture content, under the vacuum condition, from the liquid material such as foodstuffs, medicaments, etc., as frozen, in the form of upright cylindrical tubes, onto the inner wall surface of which the liquid material is caused to freeze; forming a jacket for circulating heat medium to cool this tube in the form of an outer cylinder which surrounds the outer periphery of the tube substantially concentrically; assembling the upright cylindrical tube and the jacket to surround the outer periphery of the tube in a substantially concentric outer cylindrical shape, thereby constructing the main body part of the freeze-drying apparatus; supporting this main body part on a supporting frame for apparatus; subsequently connecting a duct communicating to a vacuum exhaust system to the upper end side of the tube, while installing an opening-and-closing valve to the lower end side of the tube, or connecting a recovery chamber equipped with a valve on its bottom part; and providing, in the abovementioned duct or on the lower part of the tube, an inlet port for feeding the liquid material into the inner cavity of the tube by being connected to a pipe for feeding the liquid material.

In the freeze-drying apparatus according to the present invention, both the upright cylindrical tubes constituting the main body part of the freeze-drying apparatus and the jacket surrounding the outer periphery of the tubes, in a substantially concentric outer cylindrical form, are made to have the jacket in such substantially concentric cylindrical form on the outer periphery of each tube, without failure, by making the main body part to be juxtaposed in multiple series, even when the tubes are juxtaposed in multiple series.

In this way, in order for the liquid material to be freeze-dried onto the inner wall surface of the tubes, the heat medium can be circulated within the jacket to cool the tubes. This may be done with a single tube, as an object, the outer periphery of which is cooled with the heat medium in the jacket surrounding the outer periphery of the tube in the substantially concentric outer cylindrical form, whereby flow control of the heat medium as well as design for positioning the tube within the jacket can be done easily. As the consequence, the cooling means can be adequately controlled, and its designing and manufacturing can be done remarkably easy.

Furthermore, in case the tubes are juxtaposed in multiple series, even if there exist variations in the drying rate of the tubes when the liquid material as frozen is subjected to the vacuum drying due to sublimation of the moisture content in the material by means of the vacuum discharge system, the desiccated bulk of the liquid material, which has completed its drying, can be dropped and discharged from the lower end of each of the tubes, whereby the freeze-drying operation becomes able to be continued without need for paying the least attention to the variance in the drying rate.

In the case of assembling a multitude of tubes in the vessel-shaped jacket, there exists an important point to be taken into consideration, besides securing uniform flow of the heat medium, i.e., presence of a multitude of weld portions, at the vacuum side, to prevent the heat medium from leaking out of each tube. From the view point of securing sterilization, this welding work need utmost of the care, and, moreover, operations and controls of the freeze-drying apparatus accompany difficulties.

In the present invention, the method of attaching the concentric outer cylindrical jacket to the outer peripheral part of each of the tubes has its advantage of non-existence of the weld portions at the vacuum side of each jacket, hence the abovementioned points of difficulty in the operations and controls of the freeze-drying apparatus can be solved. Therefore, the present invention can be the most appropriate expedient from the standpoint of HACCP (Total Hygienic Control and Production Process) and CMP (Standard for Adequate Production of Medicaments).

A scale-up estimation in the apparatus for the full and actual production of the freeze-dried article can be simply figured out from an experimental scale using a single tube, wherein such single tube is juxtaposed in a plurality of numbers for producing the freeze-dried article.

Economical operations of freeze-drying apparatus according to the present invention is made possible by choosing, at every time, the number of tubes to be used, with respect to variations in the quantity of liquid material for desiccation.

The foregoing objects, other objects, and the detailed construction and function of the freeze-drying apparatus according to the present invention will become more apparent and understandable from the following detailed description thereof, when read in conjunction with the accompanying drawing.

BRIEF EXPLANATIONS OF THE ACCOMPANYING DRAWING

DETAILED DESCRIPTION OF PREFERRED EMBODIMENTS

In the following, the present invention will be described in more detail with reference to several preferred embodiments thereof as illustrated in the accompanying drawing.

Figure 3:
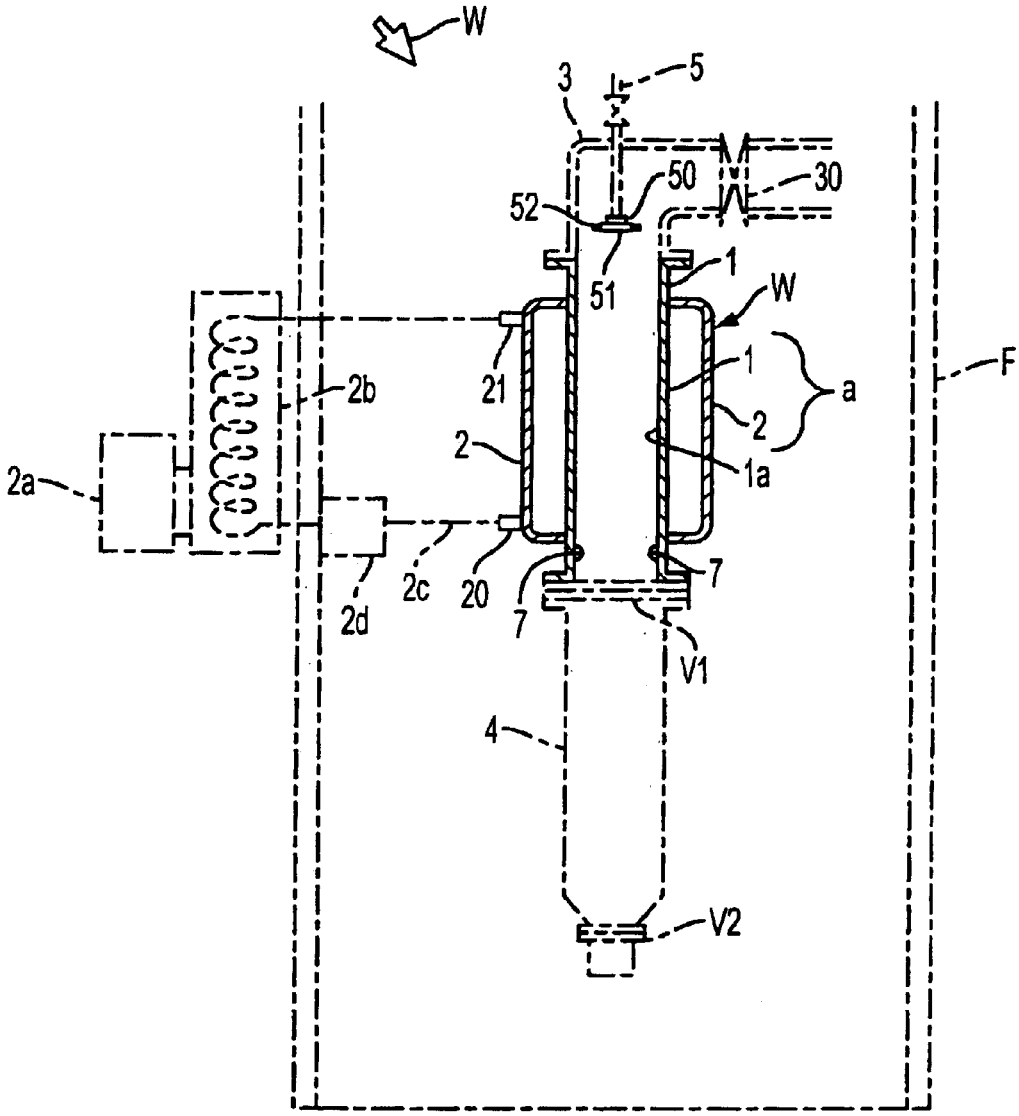
FIG. 3 is a schematic diagram of the freeze-drying apparatus according to the present invention.

The freeze-drying apparatus for foodstuffs, medicaments, etc. according to the present invention basically comprises, as shown in FIG. 3 of the accompanying drawing: a desiccating chamber for freeze-drying the liquid material of foodstuffs, medicaments, etc. by sublimating the moisture content in such material, the drying chamber of which is constructed with a multitude of upright cylindrical tubes 1, 1, . . . which function to freeze the liquid material onto the inner wall surfaces of the tubes, and a jacket 2 provided around the outer periphery of the tube 1 surrounding the same in a substantially concentric outer cylindrical form, within which jacket a heat medium for cooling the tube 1 is made to circulate without entering tube 1. The tube 1 and the jacket 2 constitute a main body part a of the freeze-drying apparatus W, and this main body a is disposed at a desired location on a machine frame F, where this main body part is to be supported.

To the upper end side of the tube 1 constituting the main body part a, there is communicatively connected, through a valve 30, a duct 3 to the vacuum exhaust system equipped with a vacuum pump and a cold trap. This duct 3, as in one embodiment shown in FIGS. 4 and 5, may be connected, in some case, through a chamber (or a spacer) 3*a* shaped in the form of a connecting tube. Then, the downstream side of the tube passageway 5 for feeding the liquid material is introduced into this duct 3 or the spacer 3*a*, and a distributive ejection head 51 is connectively provided on the inlet port 50 of this tube passageway, with additional provision of the distributive ejection nozzle 52. To the abovementioned jacket 2, there are connected, through the tube passageway 2*c*, inlet tubes 20, 20, . . . and outlet tubes 21, 21, . . . , a heat-exchanger 2*b*, and a heater 2*d* to be controllably cooled by a refrigerator 2*a*, while a valve V1 is provided at the lower end side of the tube 1 in a freely openable and closable manner, or a recovery chamber 4 with a valve V2 being provided on the bottom part thereof is connected to the tube, or the recovery chamber 4 with the valves V1 and V2 being provided on the bottom part thereof is connected to the tube. To meet this purpose, the freeze-drying apparatus W is constructed in such a fashion that the liquid material fed into the tube 1 from the distributive ejection nozzle 52 may be caused to freeze on the inner wall surface of the tube 1 by means of the heat medium to be circulated within the jacket 2, then sublimation heat is supplied from the heat medium to the liquid material as frozen to sublimate the water content in the material to capture the sublimating vapor by means of the cold trap in the vacuum exhaust system to remove it, thereby freeze-drying the liquid material, followed by opening the valve V to discharge the dried product obtained from the liquid material, which has completed its desiccation, outside the recovery chamber, or to collect the dried product into the recovery chamber.

Moreover, by mounting this freeze-drying apparatus W on the machine frame F to be disposed at a desired location, such freeze-drying apparatus W becomes able to be readily assembled.

The thus assembled freeze-drying apparatus W is in such a construction that the inlet port 50 provided for feeding the liquid material into its tube 1 is disposed within the duct 3, to which the distributive ejection nozzle 52 is connected. In this way, when the liquid material is fed from the upper end side of the tube 1, this distributive ejection nozzle 52 may be formed in such a manner that the liquid material is ejected toward the inner wall surface 1*a* of the tube 1, although, as is the case with the embodiment shown in FIGS. 4 and 5, an extension wall 1*b* which projects upward from the liquid surface of the heat medium in the jacket 2 is provided on the upper end side of the tube 1 so as to secure effective ejection of the liquid material toward the inner surface of the extension wall 1*b*.

Figure 1:
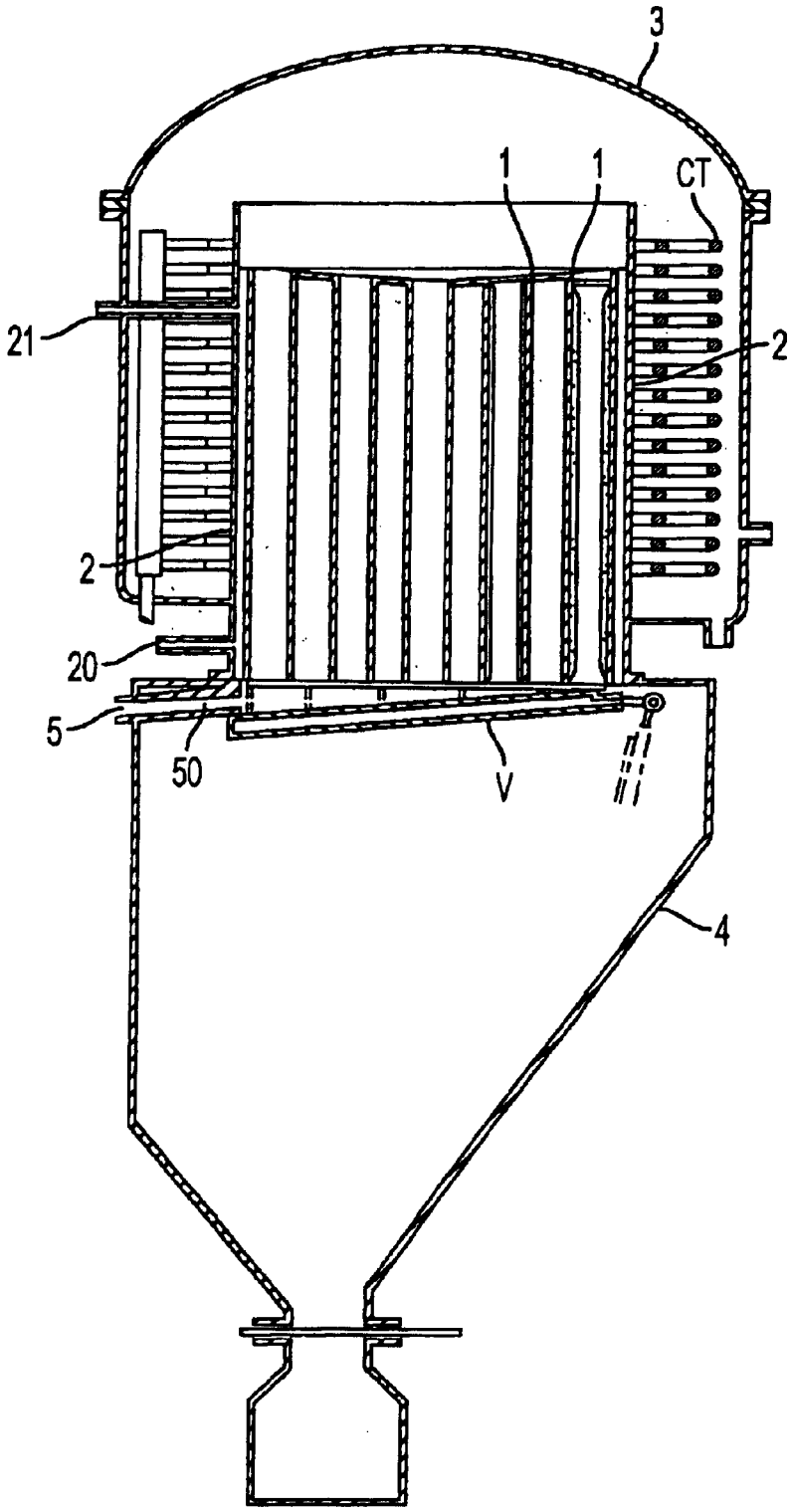
FIG. 1 (PRIOR ART)
FIG. 1 is a side elevational view in longitudinal cross section showing the main part of a prior art freeze-drying apparatus, in which the desiccating chamber is made up of a plurality of upright cylindrical tubes.
Figure 2:
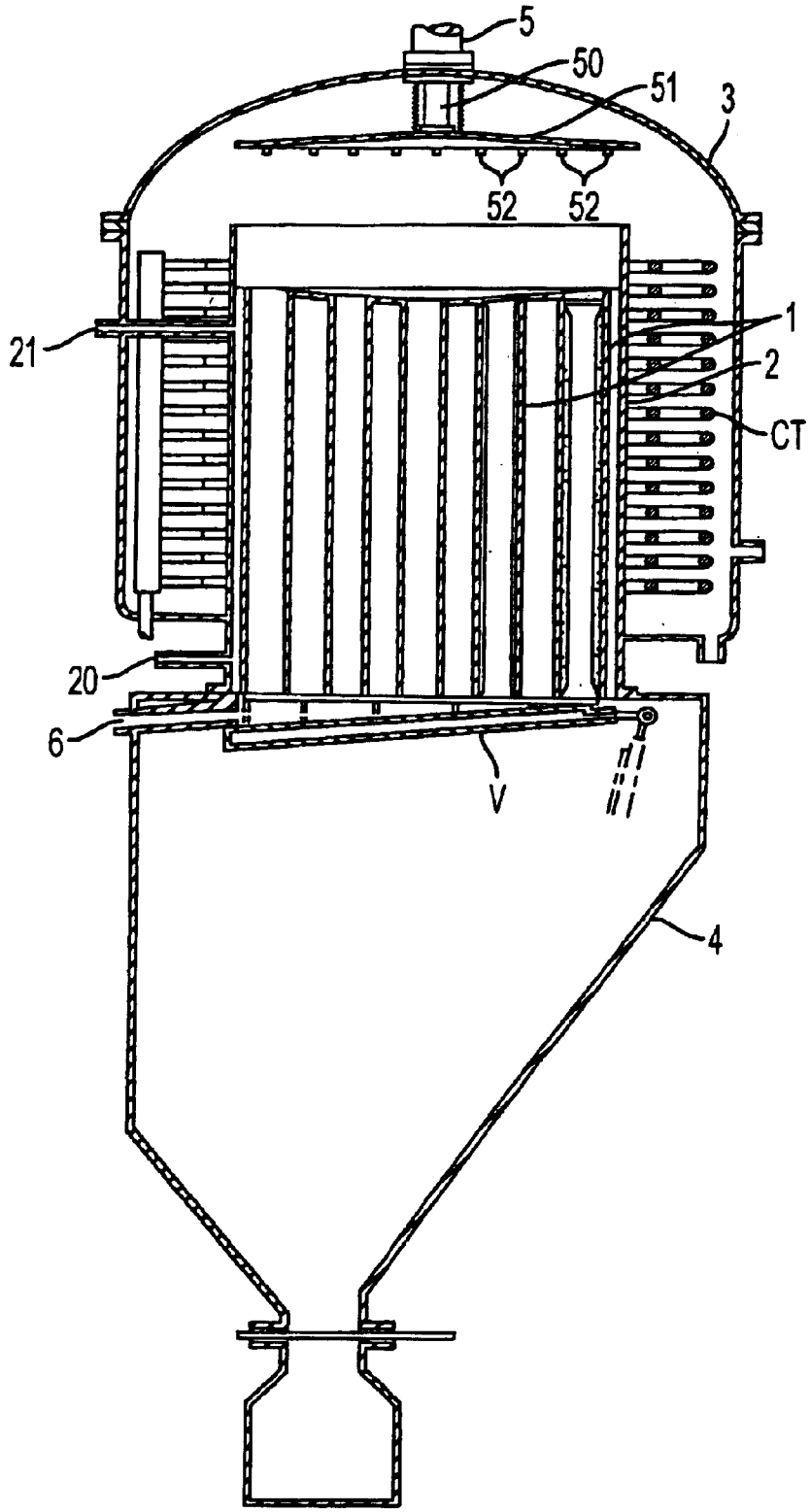
FIG. 2 (PRIOR ART)
FIG. 2 is a side elevational view in longitudinal cross section showing the main part of a prior art freeze-drying apparatus, in which the liquid material inlet port is constructed in the form of distributive ejection nozzles.

Furthermore, this inlet port 50 may be in such a construction that, as is the case with the conventional embodiment shown in FIG. 1, it may be defined at a location corresponding to the upper surface side of the valve V to be disposed at this lower end side of the tube 1 to cause the liquid material fed in and through the tube passageway 5 to be pushed up into the inner cavity of the tube 1 from its lower end side.

In some case, it may be feasible to construct the freeze-drying apparatus W assembled in the abovementioned manner, wherein, in order for the layer of the liquid material, as frozen onto the inner wall surface 1*a* of the tube by its ejection into the tube 1, to come off smoothly from this inner wall surface 1*a* of the tube 1, a spray-nozzle for distilled water is provided on this apparatus W so as to cause the liquid material to freeze onto a thin layer of an "ice-lining", which is formed on the inner wall surface 1*a* of the tube 1, prior to ejection of the liquid material (the method having been developed by the present applicant, and patented under Japanese Patent No. 1788379). In this case, the spray nozzle for distilled water can be substituted for the distributive ejection nozzle 52 by connection of a water supply pipe communicating to the distilled water tank to the tube passageway 5 which introduces the liquid material to the distributive ejection nozzle 52, in a freely changeable manner through a change-over valve.

Moreover, the step of forming and retaining the ice-lining on the inner wall surface 1*a* of the tube 1 by forming a thin film layer of the ice-lining of the distilled water onto the inner wall surface 1*a* of the tube 1, prior to the distributive ejection of the liquid material, at the time of freezing this liquid material by distributive ejection of the same onto the inner wall surface 1*a* of the tube 1, can be dispensed with by effecting the treatment for coating a synthetic resin such as "Teflon" (trademark) in thin film form onto the inner wall surface 1*a* of the tube 1.

Thus, when the ice-lining is formed beforehand onto the inner wall surface 1*a*, or when a synthetic resin coating is applied onto the inner wall surface 1*a* in place of the ice-lining, at the time of freezing the liquid material by its ejectin onto the inner wall surface 1*a* of the tube 1, since the liquid material as frozen and which is in the course of its drying, and the dried product (dried bulk) of the liquid material which has completed its drying, will become slidingly dropped off the interior of the tube 1. In order therefore to suppress this slide-falling, a device is so made as to incorporating, into this freeze-drying apparatus, supporting means for holding the liquid material in the course of its drying, or the liquid material which has completed its drying.

Figure 4:
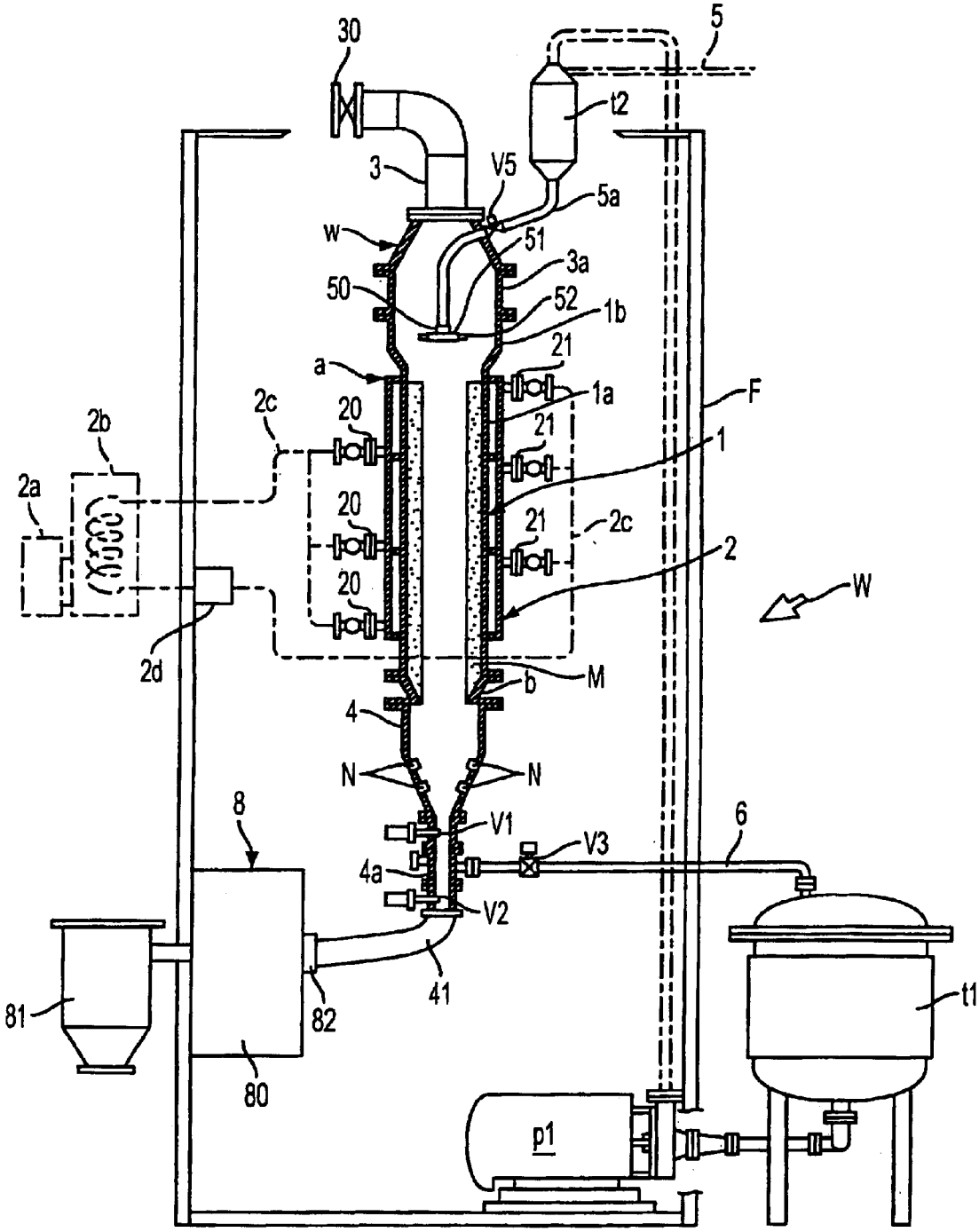
FIG. 4 is a side elevational view, partly in longitudinal cross-section, of the freeze-drying apparatus according to the present invention.

As shown in the embodiment of FIG. 4, this supporting means is so constructed that a funnel-shaped inclined wall b, with its diameter being gradually reduced as it goes downward, is formed and disposed so that its lower end side may be positioned below the lower edge of the liquid material M which is to be frozen into a cylindrical layer having a predetermined thickness on the inner wall surface 1*a*. In this way, the lower edge of the liquid material M which has been frozen in a cylindrical shape, and which falls down slidingly from the interior of the tube 1. As soon as the desiccating step has terminated, the desiccated product of this liquid material is coarsely crushed under the pressure of the pressurized air blown out of the pressurized air nozzle which is provided within the duct 3 or the spacer 3*a*, after which this coarsely crushed product of the liquid material may be dropped downward into the recovery chamber 4 which is connectively provided below the tube 1.

Furthermore, as in the embodiment shown in FIG. 5, this supporting means has a supporting member 7 for supporting the lower end part of dried bulk of the liquid material provided in a protruded manner toward the inner cavity of the tube 1 from its inner surface, at the lower end side of the inner wall surface of the tube 1, and, at a location positioned below the jacket 2 which surrounds the tube 1 in an outer cylindrical shape, preferably in a freely controllable manner for its in-out operations. As soon as the freeze-drying step of the liquid material terminates, this supporting member 7 is retracted inwardly of the inner wall surface of the tube 1 so as to cause the dried bulk of the liquid material, which has been kept desiccated in a cylindrical shape, to drop into the recovery chamber 4.

Figure 5:
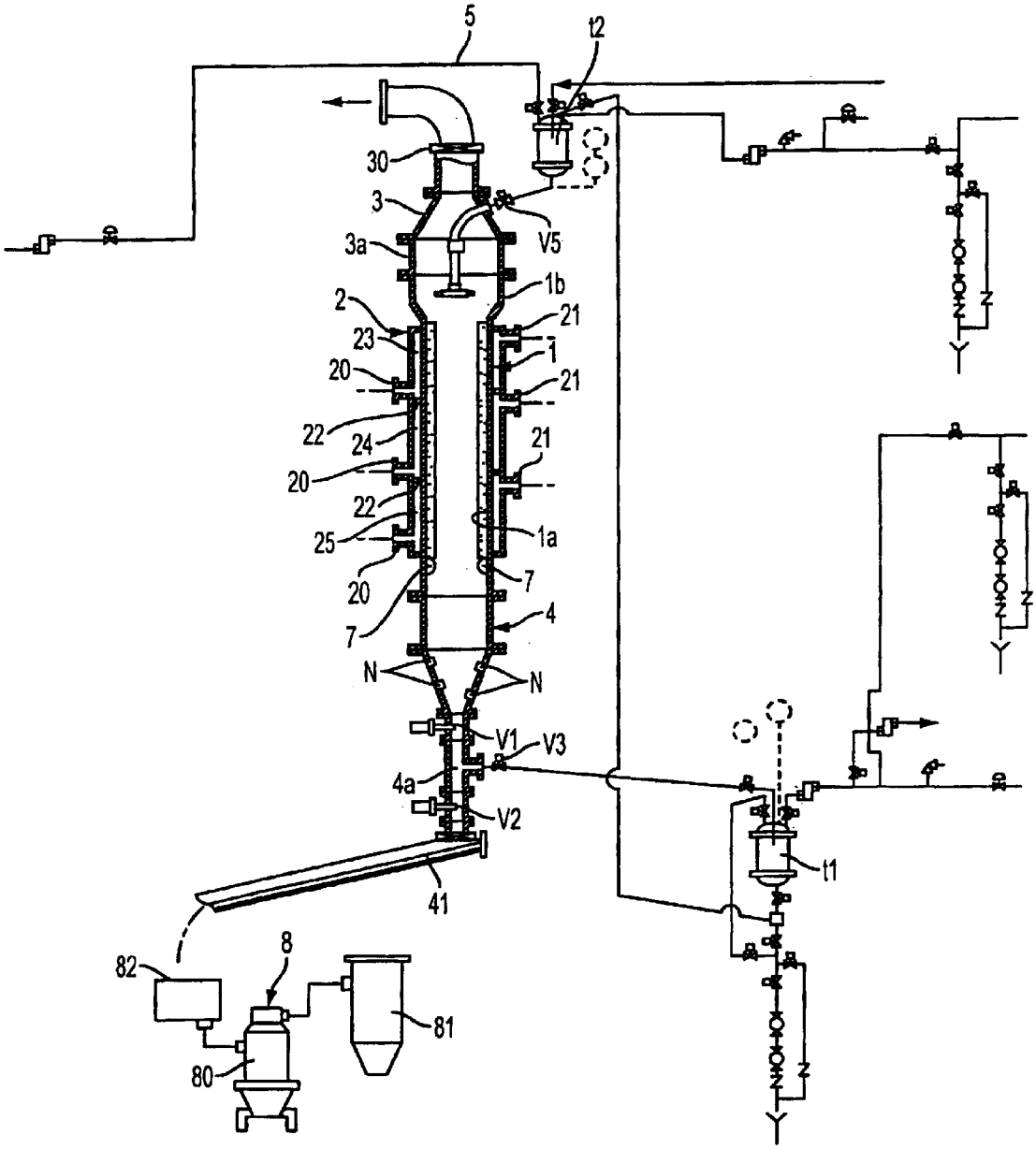
FIG. 5 is a developed view, partly cut-away, of another embodiment of the freeze-drying apparatus according to the present invention.

In case the liquid material is made to be fed into the inner cavity of the tube 1 from the upper end side thereof, the jacket 2 to be provided, on the outer periphery of the upright cylindrical tube 1 in the outer cylindrical shape, is so constructed that, as in the embodiment shown in FIGS. 4 and 5, the inner cavity of this jacket 2 is divided into a plurality of sections 23, 24 and 25 in the up-and-down direction along the tube 1 by means of partitioning walls 22, 22, . . . , then an inlet tube 20 and an outlet tube 21 for the heat medium are provided in each and every section 23, 24 and 25 so as to enable the heat medium to be fed into, and circulated in and through, each section. In the meantime, the temperature control of this heat medium is effected for each section to cool the tube 1 by means of the heat medium circulating in and through the outer peripheral side thereof in such a manner that, as an example, the cooling may be done at a temperature level which becomes sequentially higher from the upper part, through the intermediate part, and to the lower part of the tube 1, whereby the liquid material flowing down along the inner wall surface of the tube 1 becomes gradually cooled during its flow-down movement, which functions effectively to prevent the frozen layer of the liquid material from becoming thicker, hence the frozen layer having uniform thickness becomes able to be secured.

As shown in the embodiment of FIGS. 4 and 5, the valve to be provided on the lower end side of the tube 1 is so constructed that, when a recovery chamber 4 in a cylindrical shape is connected to the lower end side of the tube 1 to be provided on the bottom part of the recovery chamber 4 as the valve V1, a discharge tube 4*a* shaped in the form of a short joint tube, which serves as a take-out tube for crushed product of the desiccated bulk and a take-out tube for unfrozen liquid material as well, is connected below the valve V1; then, a second valve V2 is provided at the lower end side of the discharge tube 4*a*, to which a take-out tube 6 for drawing the unfrozen liquid material out into this discharge tube 4*a* is connected by way of a valve V3; and a conveying tube 41 for the crushed product is connected on the lower end of the discharge tube 4*a* through the above-mentioned second valve V2. When the liquid material is to be fed into the tube 1, both valve V1 and valve V3 are opened, while the second valve V2 is closed, thereby feeding the liquid material into the tube 1 so as to collect the unfrozen liquid material into this discharge tube 4*a*, which is to be taken outside by the take-out tube 6, in preparation for freezing the liquid material onto the inner surface of the tube 1 to a frozen layer of a predetermined thickness.

Desiccation of the liquid material, which has been frozen on the inner wall surface 1*a* of the tube 1, is done by closing the valve V1. The desiccated bulk of the liquid material which has completed its drying is dropped into the recovery chamber 4. When the desiccated bulk is comminuted by the jet nozzles N, N, . . . which are provided in the recovery chamber 4, both valves V1 and V2 are kept open so that the crushed product can be transported into the conveying tube 41 through the discharge tube 4*a* by the force of the pressurized air.

Figure 6:
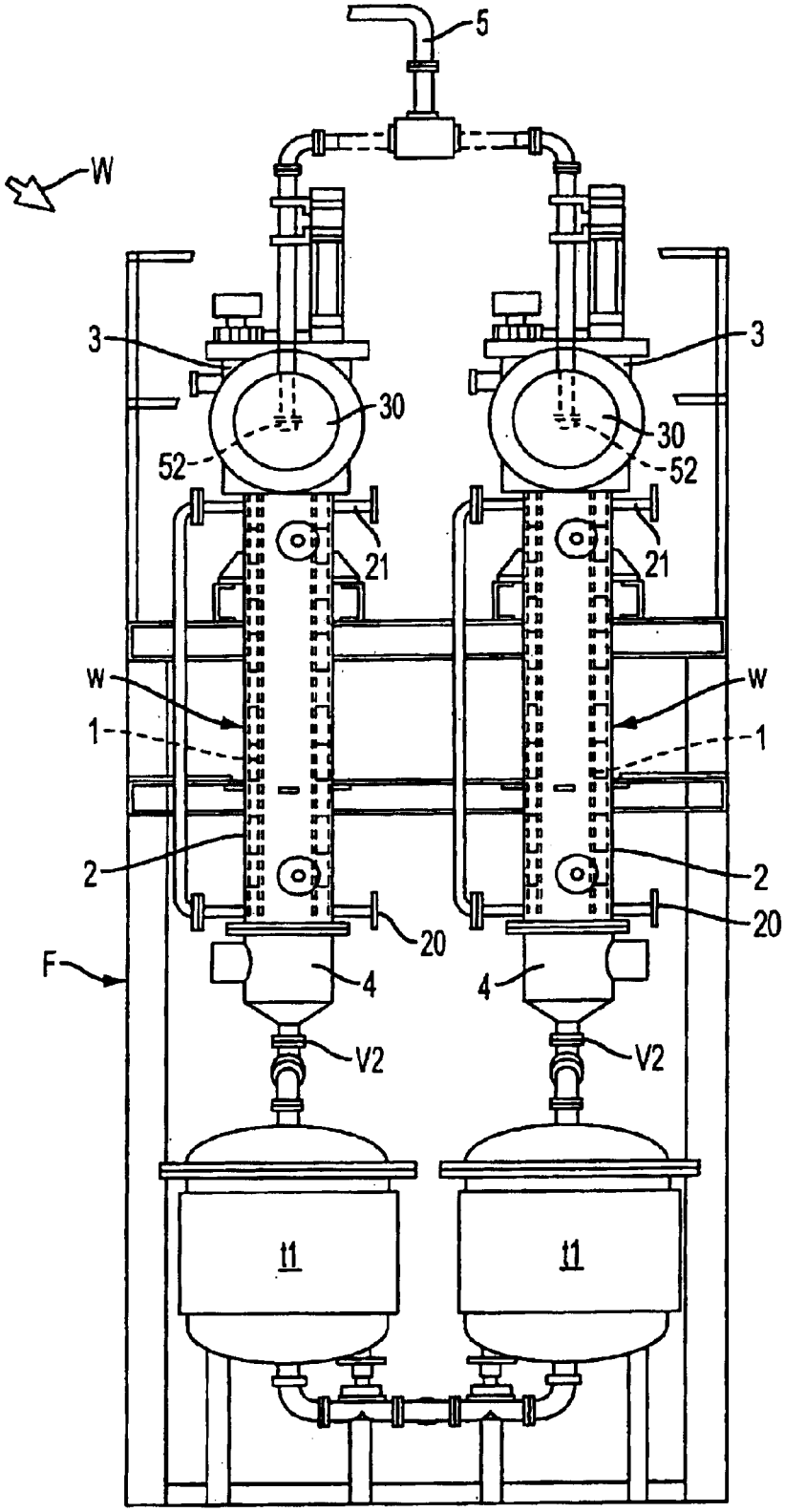
FIG. 6 is a developed view, partly cut-away, of still another embodiment of the freeze-drying apparatus according to the present invention.
Figure 7:
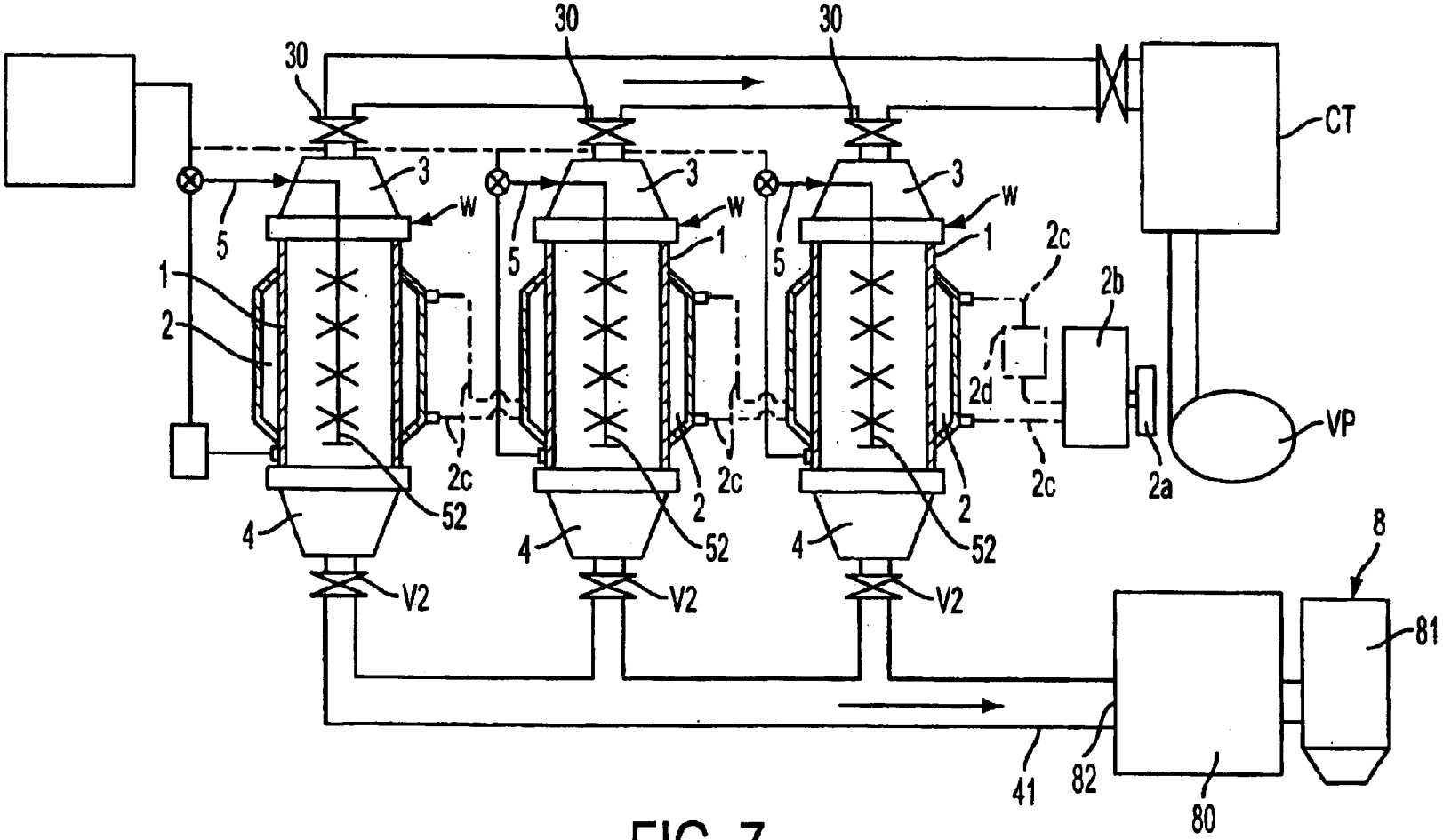
FIG. 7 is a developed view, partly cut-away, of other embodiment of the freeze-drying apparatus according to the present invention.

When it is desired to arrange the tube 1 side by side in multiple series for increasing the production capacity of the freeze-drying apparatus W according to the present invention, as described in the foregoing, the main body part a of the freeze-drying apparatus W, constructed with the single, upright cylindrical tube 1 and the jacket 2 provided to surround the outer periphery thereof in a substantially concentric, outer cylindrical shape, is held on the machine frame F by juxtaposing such main body of the freeze-drying apparatus w in double or more numbers, as shown in FIGS. 6 and 7; then, to each of these main body parts a, a, . . . , there is assembled the duct 3 communicated with the vacuum exhaust system which is connected to the upper end side of the tube 1, the inlet port 50 provided at the end part of the downstream side of the tube passageway 5 for supplying the liquid material into the inner cavity of the tube 1, and the recovery chamber 4 provided with the valve V1 connected to the lower end side of the tube 1, or the valve V2 provided at the bottom part of the tube. In this way, there is constructed the freeze-drying apparatus W, wherein a plurality of the freeze-drying apparatuses W are mounted on the machine frame in unit formation.

In this case, the ducts 3, each being communicatively connected to the upper end side of the tube 1 of each unit, are connected in parallel, through the opening-and-closing valve 30, with respect to the vacuum exhaust system equipped with the vacuum pump VP and the cold trap CT, as shown in the embodiment of FIG. 7, whereby sublimation of the moisture content in the liquid material as frozen within each of the parallelly arranged tubes 1, 1, . . . as well as capturing of the water vapor as sublimated can be realized by dual use of the vacuum pump VP and the cold trap CT installed in the vacuum exhaust system.

Also, the tube passageway 2*c* for introducing into the heat exchanger 2*b* the heat medium to be circulated in the jacket 2, which is disposed on the outer periphery of each of the tubes 1, 1, . . . in the juxtaposed unit formation, can be kept connected in the parallel relationship, through a valve which opens and closes with respect to a tube passageway 2*c* of a heat-exchanging apparatus 2*b* to be cooled by a refrigerating apparatus 2*a* and a heating apparatus 2*d*, thereby making it possible to circulate the heat medium by dual use of the refrigerating apparatus 2*a*, the heat-exchanging apparatus 2*b*, and the heating apparatus 2*d*, for each of the jackets 2, 2, . . . of the main body parts a, a, . . . in the juxtaposed unit formation. Such construction is feasible.

Moreover, the take-out tube 6 for removing the unfrozen liquid material from the liquid material fed into the tube 1, which remains unfrozen after the liquid material has been made frozen on the inner wall surface of the tube 1, is connected in its downstream side to a recovery tank t1 for the unfrozen liquid material, which is installed in the vicinity of the machine frame F.

The unfrozen liquid material to be recovered into this recovery tank t1 is pumped up by a suction pump p1 into a second recovery tank t2 which is disposed upward of the duct 3 mounted on the machine frame F and communicatively connected with the vacuum exhaust system of the freeze-drying apparatus W which is also mounted on the machine frame F, as described in the foregoing. Thus, the liquid material is made to be fed into the distributive ejection nozzle 52 which is connected to the tube 5 through the valve V5, and is made to be fed again into the tube 1.

A reference numeral 8 designates a crushing apparatus for comminuting the desiccated bulk of the liquid material which has completed its freeze-drying in the tube 1, and which has been discharged by dropping off the tube 1. This crushing apparatus 8 is of an ordinary type, which is made up of the crushing apparatus 80 equipped with a power mill and a jet mill, and a cyclone separator 81 for separating powder from air. The inlet port 82 of the crushed product is connected, through the conveying tube 41, to a discharge port 40 defined in the bottom part of the recovery chamber 4 formed by connecting the same to the lower end side of the abovementioned tube 1. By opening the valve V2 provided on the bottom part of the recovery chamber 4, suction pressure of the cyclone 81 of the crushing apparatus is caused to function, or, by causing the pressure to act, the desiccated bulk of the liquid material discharged from the discharge port 40 is received and crushed.

A reference letters N, N, . . . designate nozzles for blowing out pressurized air, provided on the inner face of the peripheral wall of the recovery chamber 4 to cause the air pressure from the side of the recovery chamber 4 to act on the desiccated bulk of the liquid material, when the desiccated bulk as recovered into the recovery chamber 4 is fed toward the inlet port 82 of the crushing apparatus 8. These nozzles also serve to crush and comminute the desiccated bulk of the liquid material as recovered into the recovery chamber.

There are two cases of disposing these ejection nozzles N, N, . . . for the pressurized air: the one is a case where it is disposed within the duct 3 to be connected with the upper end side of the tube 1 for preventing powder material produced at the time of crushing and comminuting the desiccated bulk of the liquid material from flying up and scattering toward the inner cavity of the tube 1 by the jet air to be ejected from the nozzles N, N, . . . and the other is a case where separate nozzles are disposed to the side of the duct, besides the nozzles N, N, . . . to be provided at the side of the recovery chamber 4, in a state of the valve 30 provided at the duct 30 being closed, so that the space extended from the interior of the duct 3 into the recovery chamber 4 through the inner cavity of the tube 1 is brought to a pressurized state toward the discharge port 40 of the recovery chamber 4.

This nozzle N to be provided in the duct 3 can be so constructed that, in the case of the distributive ejection (inlet) port 50 for the liquid material into the tube 1 being formed in the ejection nozzle to force out the liquid material, this ejection nozzle 50 can also be used as the nozzle N.

Figure 8:
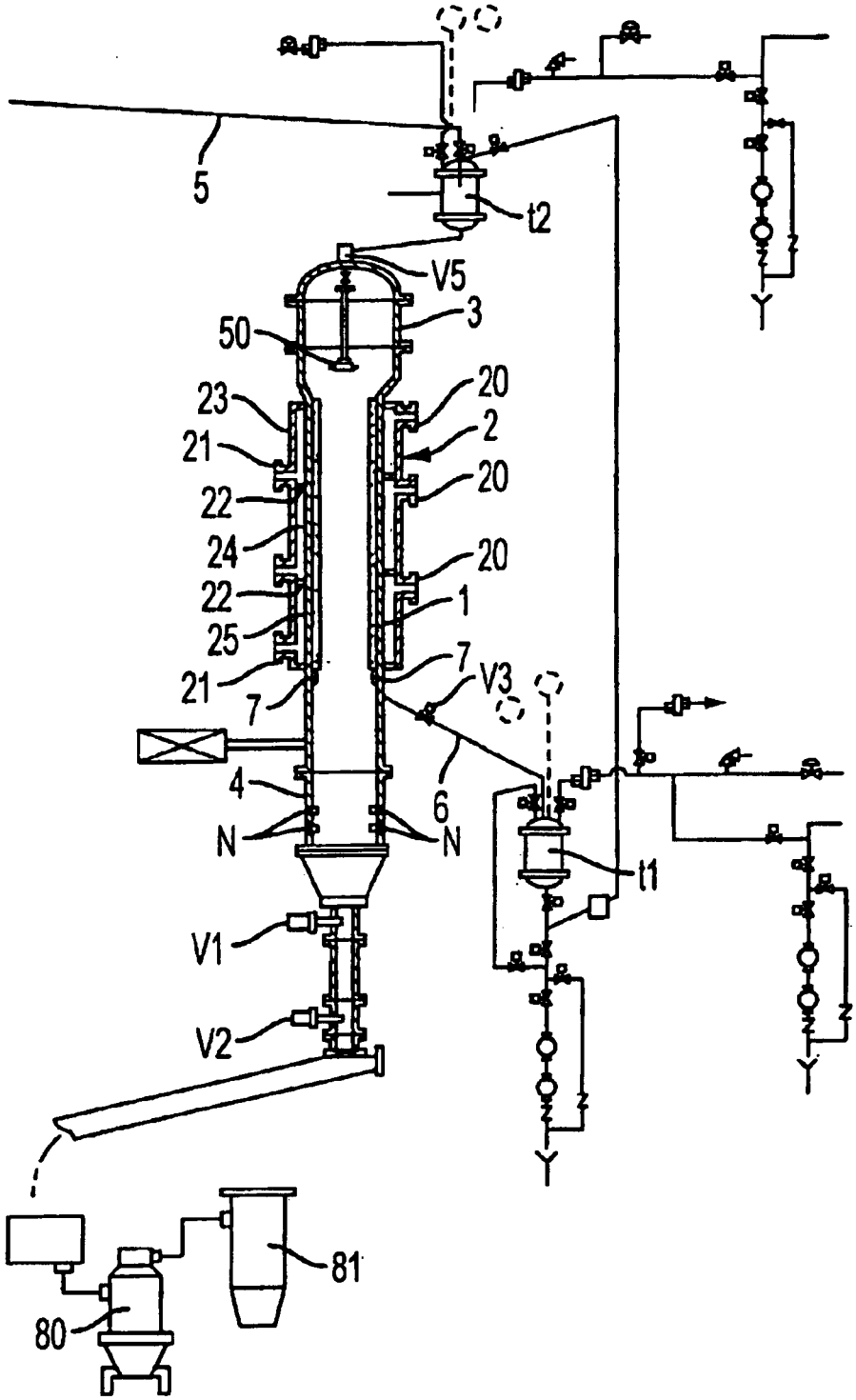
FIG. 8 is a developed view, partly cut-away, of still other embodiment of the freeze-drying apparatus according to the present invention.
Figure 9:
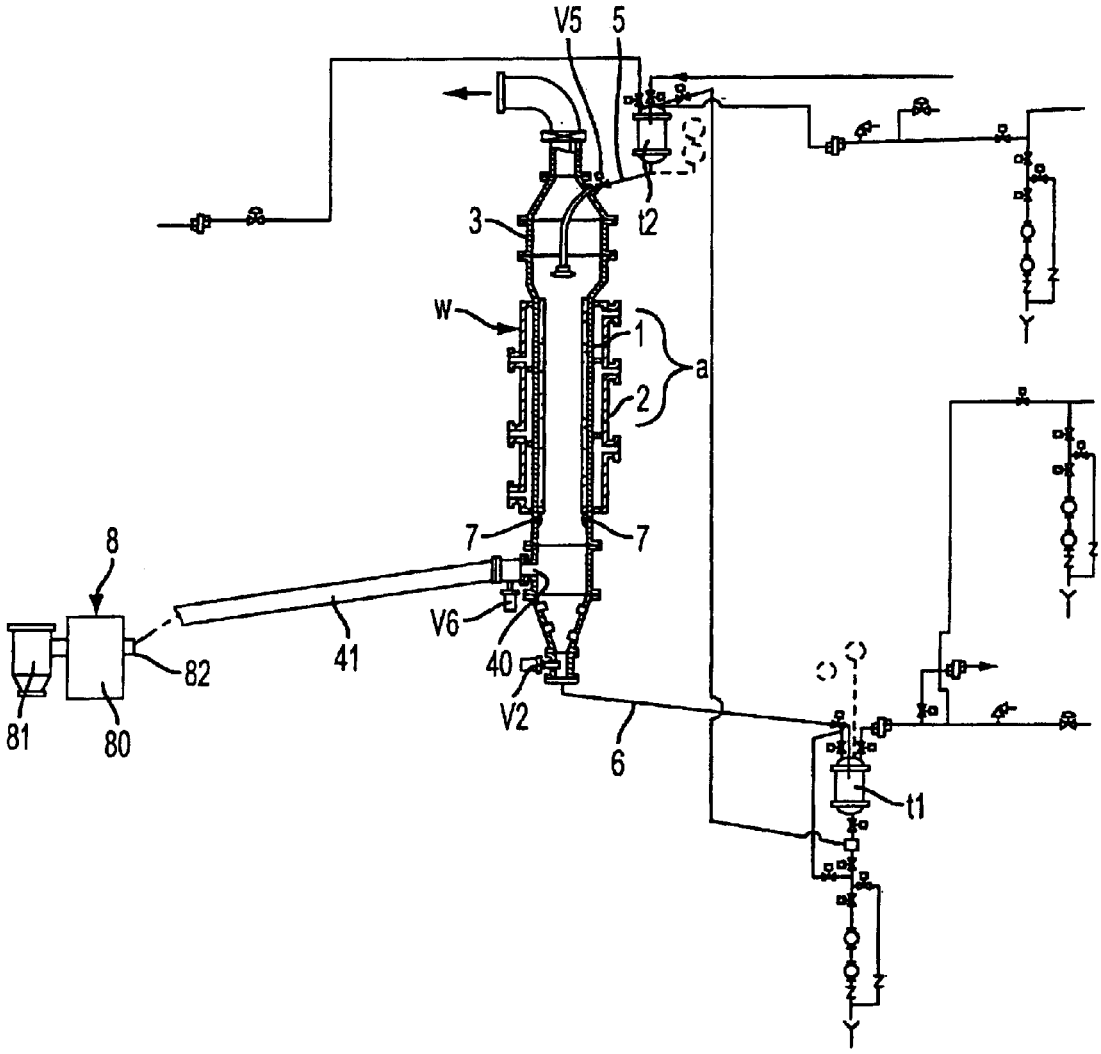
FIG. 9 is a developed view, partly cut-away, of a further embodiment of the freeze-drying apparatus according to the present invention.

FIG. 9 illustrates a modified embodiment of the freeze-drying apparatus W according to the present invention. This embodiment is as same as the above-described embodiment shown in FIG. 8, in that the main body part of the freeze-drying apparatus is made up of the upright cylindrical tube 1 and the jacket 2 surrounding the outer periphery of the tube in an outer cylindrical shape, and this main body part is mounted on the machine frame F to be installed at a desired location; and that the duct 3 communicating to the vacuum exhaust system is connected with the upper end side of the tube 1, then the inlet port 50 for ejecting the liquid material into the tube 1 is disposed in the duct 3 and connected with the tube passageway 5, and, at the same time, of the liquid material to be ejected into the tube 1 through this inlet port, an excess amount of the liquid material which flows down in its unfrozen state is taken out of the take-out tube 6 and recovered into the recovery tank t1, and finally this excess amount of the liquid material is pumped up by the air pressure into the second recovery tank 2 so as to be fed into the inlet port 50 again. The take-out tube 6 for removing the unfrozen liquid material is communicatively connected to the blindly clogged bottom part of the cylindrical recovery chamber 4 which is connectively disposed at the lower end side of the tube 1.

The discharge port 40 to be provided in this recovery chamber 4 is defined in the peripheral wall of the cylindrical barrel part of the recovery chamber 4. The desiccated bulk as crushed by the nozzle N provided in the recovery chamber 4 is made to be sent into the inlet port 82 of the crushing apparatus 8 from the conveying tube 41.

At this time, if and when the desiccated bulk in the recovery chamber 4 is sufficiently comminuted by the pressurized air ejected from the nozzle N, the front end side of the conveying tube 41 may be directly connected to the cyclone separator 81.

As has so far been described in the foregoing, since the freeze-drying apparatus for foodstuffs, medicaments, etc. according to the present invention is constructed in such a manner that the desiccating chamber for freezing the liquid material, and for sublimating the moisture content in the material under the vacuum condition to thereby desiccate the material, is formed in an upright cylindrical tube 1; then, when the liquid material to be supplied into the tube 1 is made to be frozen in a cylindrical shape on the inner wall surface 1*a* thereof, by providing the jacket 2 for circulating the heat medium on the outer periphery of the tube 1, such jacket for circulating the heat medium to cool the tube is formed in an outer cylindrical shape surrounding the outer periphery of the tube in the substantially concentric manner. With this tube and this jacket surrounding the outer periphery of the tube in a substantially concentric outer cylindrical shape being assembled together, the main body part of the freeze-drying apparatus W is obtained. Subsequently, this main body part of the freeze-drying apparatus is mounted on the machine frame, followed by connection of the duct communicating with the vacuum discharge system to the upper end side of the tube, while the recovery chamber equipped with the valve at the lower end side of the tube, or equipped with the valve on the bottom part thereof is connected so as to construct the freeze-drying apparatus with the inlet port for feeding the liquid material into the tube having been defined in the duct or in the lower end part of the tube. Therefore, it becomes possible to cool the tube for freezing the liquid material in the cylindrical form on the inner wall surface of the upright cylindrical tube by the control of each and every tube for each jacket surrounding the tube in the concentric outer cylindrical shape. As the consequence, designing of the freeze-drying apparatus becomes easy, hence the control of the tube for freezing the liquid material in the cylindrical form onto the inner wall surface of the tube can be effected simply and accurately.

Although, in the foregoing, the present invention has been described with reference to those preferred embodiments thereof, it should be understood that these embodiments are merely illustrative and not so restrictive, and that any changes and modifications may be made by those skilled in the art within the spirit and scope of the invention as recited in the appended claims.

What is claimed is:

1. Freeze-drying apparatus for foodstuffs and medicaments, which comprises: a main body part constructed by assembling an upright cylindrical tube for freezing liquid material feed to be dried, onto an inner wall surface of said cylindrical tube; and a jacket provided on and around the outer periphery of said tube in a substantially concentric cylindrical shape to permit a heat medium to circulate in the jacket around said outer periphery of said cylindrical tube, wherein said heat medium does not enter said tube, a duct communicating to a vacuum exhaust system, which is connected to the upper end side of said tube of said main body part, either directly or through a chamber, an inlet port for introducing said liquid material feed to be dried onto the inner cavity of said tube, said inlet port being connected to a downstream side of a tube passageway for feeding said liquid material, within said duct or said chamber, and above said tube; and an extended wall projecting above a liquid surface of said heat medium is disposed on the upper end side of the cylindrical wall of said tube, to enable said liquid material ejected from said inlet port onto the inner surface of said extended wall to eject from said inlet port against the inner surface of said extended wall.

2. Freeze-drying apparatus for foodstuffs and medicaments, according to claim 1, wherein said main body part of said freeze-drying apparatus is constructed by assembling said upright cylindrical tube for freezing said liquid material feed to be dried onto the inner wall surface of said cylindrical tube, and the jacket provided on and around the outer periphery of said tube in a substantially concentric cylindrical shape for circulating the liquid heat medium within the interior of said jacket, said main body part of the freeze-drying apparatus being connected in a plurality of parallel rows, and mounted on a machine frame, ducts communicating to said vacuum exhaust system being connected, either directly or through the chamber, to the upper end side of said respective upright cylindrical tubes of said main bodies arranged in parallel rows, the lower end side of each of the respective upright cylindrical tubes being provided with opening-and-closing valves, or with a recovery chamber equipped with valve on the bottom part thereof; and the inlet port for introducing liquid material feed into the inner cavity of said each tube by being connected to the downstream side of the tube passage for feeding the liquid material.

3. Freeze-drying apparatus for foodstuffs and medicaments, according to claim 1, wherein said main body part of the freeze-drying apparatus is constructed by assembling the upright cylindrical tube for freezing said liquid material feed onto the inner wall surface of the cylindrical tube, and the jacket provided on and around the outer periphery of said tube in a substantially concentric shape for circulating the liquid heat medium in the interior of said jacket, said main body part of the freeze-drying apparatus being connected in a plurality of parallel rows and supportively held on a machine frame, the upper end side of said respective upright cylindrical tubes of the main body part being made open to the duct or the chamber communicating to said vacuum exhaust system supportively held on the machine frame, while the lower end side of said tubes being each connected to the opening-and-closing valve or to the recovery chamber equipped with the valve on the bottom part thereof, and further said inlet port for introducing the liquid material feed into the inner cavity of said each upright cylindrical tube, said inlet port being disposed within said chamber connected to said duct or the chamber joined to said duct.

4. Freeze-drying apparatus for foodstuffs and medicaments, according to claim 1, wherein said main body part of the freeze-drying apparatus constructed by assembling the upright cylindrical tube for freezing the liquid material as fed onto the inner surface of said cylindrical wall, and the jacket provided on and around the outer periphery of said tube in a substantially concentric shape on the outer periphery of the tube to permit the liquid heat medium to circulate in the interior of said jacket, is connected in a plurality of parallel rows, and supportively held on a machine frame, the upper end side of said respective upright cylindrical tubes of the main body parts is made communicatively connected to the duct communicating to said vacuum exhaust system through the freely opening-and-closing valves.

5. Freeze-drying apparatus for foodstuffs and medicaments, according to claim 1, wherein said main body part of the freeze-drying apparatus constructed by assembling the upright cylindrical tube for freezing the liquid material feed to be dried onto the inner surface of the cylindrical wall, and the jacket provided on and around the outer periphery of said tube in a substantially concentric shape to cause the liquid heat medium to circulate in the interior of said jacket, is connected in a plurality of parallel rows, and supportively held on a machine frame, said jacket to be provided on the outer periphery of said respective upright cylindrical tubes of said main body parts arranged in a plurality of parallel rows being commonly used with a heater, a refrigerator, and a heat-exchanger for the liquid heat medium to be circulated in and through said respective jackets of the main body parts as connected in parallel without entering said tube, by a tube passageway guiding said heat medium to be circulated in and through said jacket, in parallel with a tube passageway of the heat-exchanger and the heater to be cooled by the refrigerator.

6. Freeze-drying apparatus for foodstuffs and medicaments, according to claim 1, wherein said upright cylindrical tube for freezing the liquid material feed onto the inner surface of the cylindrical tube is provided with a funnel-shaped inclined wall with a diameter thereof being gradually reduced in the downward direction, at a position projecting below said jacket, which surrounds the outer periphery of said tube in an outer cylindrical shape, and circulates the liquid heat medium in the interior of said jacket, said inclined wall being disposed at a position below the lower edge so that the diameter-reduced portion at the lower end side comes to a position below the lower edge of the liquid material feed to be frozen in the cylindrical shape on the inner wall surface of said tube.

7. Freeze-drying apparatus for foodstuffs and medicaments, according to claim 1, wherein said upright cylindrical tube for freezing the liquid material to be dried onto the inner surface of said tube is provided with a support member, either fixedly or movably into and out of the inner cavity of said cylindrical tube, for supporting the lower edge of the layer of said liquid material frozen onto the inner wall surface of said tube by being protruded from the inner surface of said tube toward a position occupying beneath the lower edge of the layer of said liquid material frozen in the cylindrical form onto the inner wall surface of said tube, on said inner surface at a position protruding downward of the jacket which surrounds the outer periphery of said tube, and causes the liquid heat medium to circulate in and through said jacket.

* * * * *